United States Patent [19]

Purcupile et al.

[11] 4,026,116

[45] May 31, 1977

[54] MINE ROOF SUPPORTING

[75] Inventors: John Charles Purcupile, Monroeville; Angela L. Lenden, Coraopolis; Thomas A. Mutschler, Pittsburgh, all of Pa.; Joel D. Kneisley, Cleveland, Ohio; Mark P. Wieszczyk, San Francisco, Calif.; Ronald Lasser, Williamsville, N.Y.; Donald W. Fulmer, Morgantown, W. Va.

[73] Assignee: Carnegie-Mellon University, Pittsburgh, Pa.

[22] Filed: Dec. 9, 1975

[21] Appl. No.: 639,010

[52] U.S. Cl. ..... 61/45 B; 61/63; 173/49

[51] Int. Cl.[2] ..... E21C 11/02; E21D 20/00

[58] Field of Search ..... 61/45 B, 45, 63; 175/19; 173/49, 46, 52; 85/46, 64

[56] References Cited

UNITED STATES PATENTS

| | | | |
|---|---|---|---|
| 3,431,988 | 3/1969 | Bodine, Jr. | 175/19 X |
| 3,454,070 | 7/1969 | Phipard, Jr. | 151/22 C |
| 3,664,459 | 5/1972 | Stephens et al. | 182/141 |
| 3,842,610 | 10/1974 | Willis et al. | 61/63 |
| 3,942,329 | 3/1976 | Babcock | 61/45 B |

FOREIGN PATENTS OR APPLICATIONS

| | | | |
|---|---|---|---|
| 1,072,942 | 1/1960 | Germany | 61/45 B |

*Primary Examiner*—Jacob Shapiro
*Attorney, Agent, or Firm*—Hymen Diamond

[57] ABSTRACT

A roof pin-or-bolt setting machine which applies sonic energy to drive bolts which may be of non-circular section or helical into the roof of a coal mine. The energy is supplied by a bar which is set into sonic vibration in its bending mode so that there is a standing wave along the bar having nodes and anti-nodes. The bolt is supported vertically at an anti-node position of the bar and is driven into the roof as the bar is vibrated. Continuous vertical force is applied to the bar to maintain the bolt in engagement with the roof under pressure.

9 Claims, 14 Drawing Figures

FIG.4
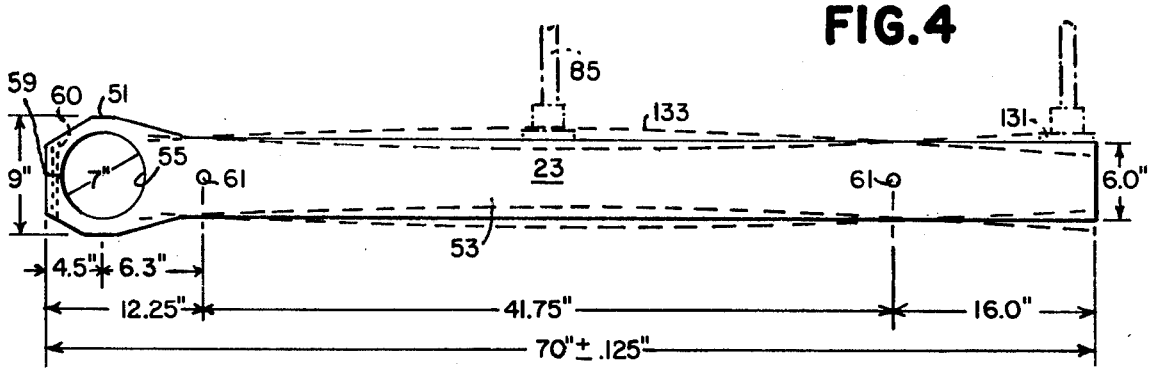
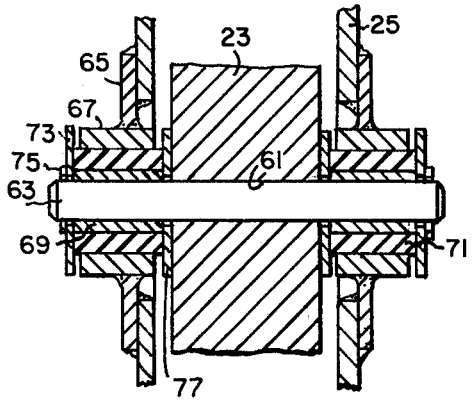
FIG.5
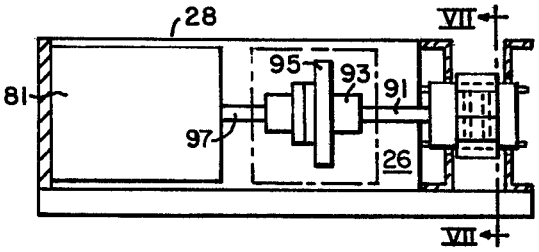
FIG.6
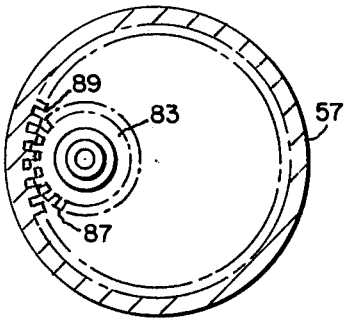
FIG.7
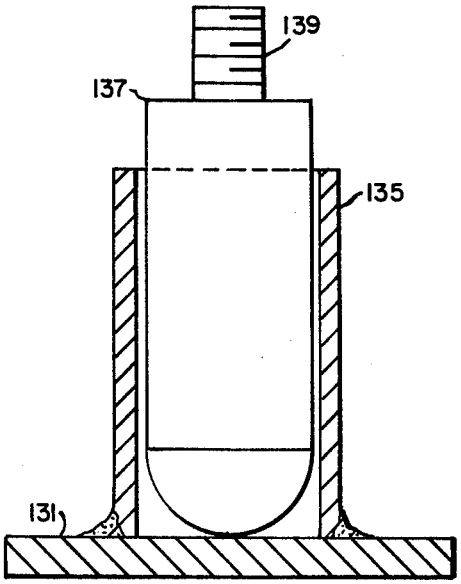
FIG.8

FIG.9
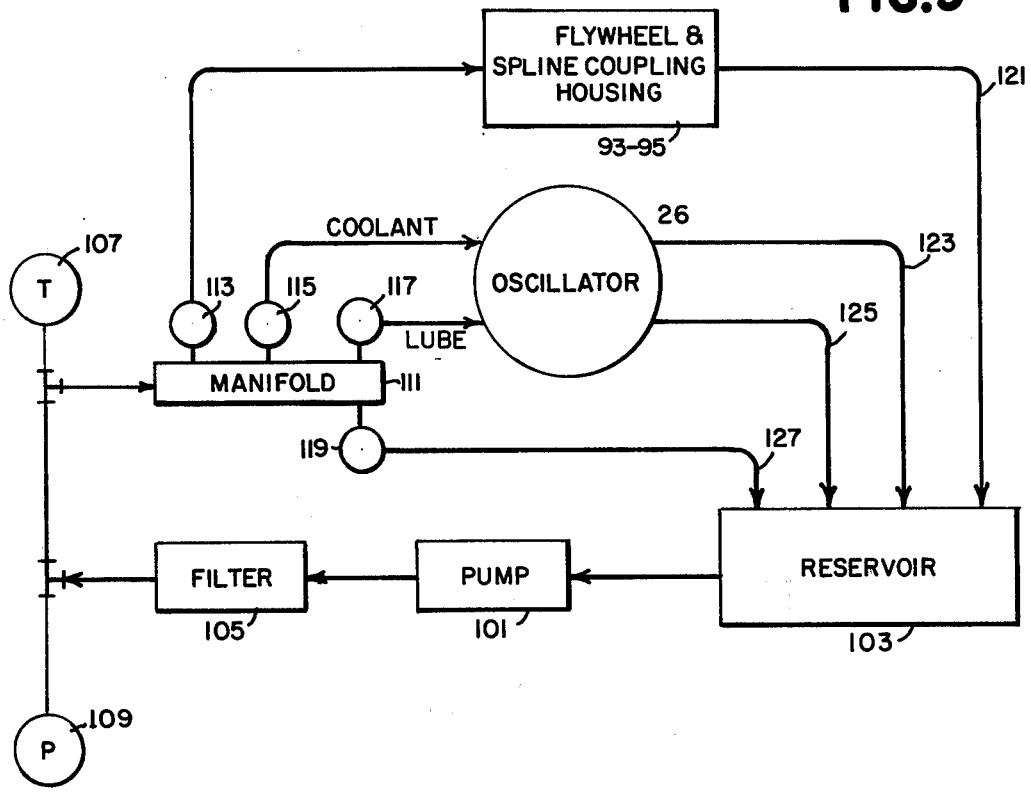
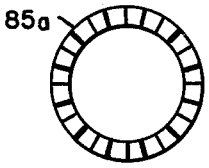
FIG.11a
FIG.10
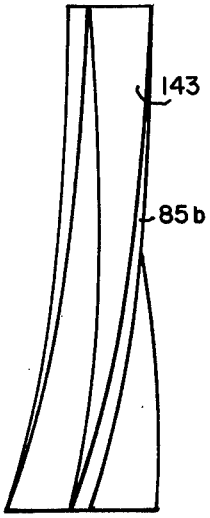
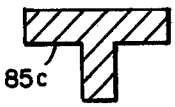
FIG.11b
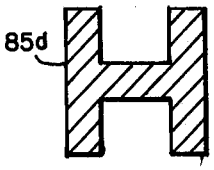
FIG.11c
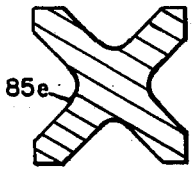
FIG.11d

MINE ROOF SUPPORTING

BACKGROUND OF THE INVENTION

This invention relates to the art of supporting the roof of a coal mine or the like and has particular relationship to pin-or-bolt setting for such a roof.

In the interest of safety in the operation of a coal mine, it is essential that the roof of the mine be reliably secured against caving in. To support the roof it is common to insert bolts into the roof. The task of inserting the bolts in the roof is necessarily the most hazardous task involved in a coal mining operation. It is an object of this invention to minimize the hazard involved in roof bolting.

In accordance with the teachings of the prior art, holes are drilled in the roof of the mine and the bolts are inserted in the holes. For this purpose it is necessary that the bolts be of circular section This practice, in addition to being manual so that it does not lend itself to automation, is highly time consuming, and thus, is not only uneconomic, but presents maximum hazard to the personnel involved. It has also been proposed (U.S. Pat. Nos. to Gerald W. Elders, et al, 3,643,542; 3,721,094; 3,734,380; 3,819,101) to drive the bolt into the roof by application of constant force to the bolt. The practice of this proposal requires circularly cylindrical bolts. This approach proved unsatisfactory because the high force demanded bent the bolt instead of driving it into the strata. In addition, the bolt sought the path of least resistance through the strata.

It is an object of this inventon to overcome the disadvantages of the prior art and to provide effective apparatus and a method for setting bolts into the roof of a coal mine or the like which apparatus and method shall be economic, shall minimize the hazard of the task of bolt setting and shall readily lend itself to automation.

SUMMARY OF THE INVENTION

In accordance with this invention, the bolts are driven into the roof, without drilling holes in the roof by applying sonic energy to the bolts. The sonic energy is generated as disclosed by Albert G. Bodine, Jr. (see for example Bodine Pat. Nos. 3,299,722, 3,352,369, 3,402,612, 3,417,966, 3,581,969 incorporated herein by reference) generally by an orbiting inertial roller which rolls inside of a cylindrical raceway exerting radial centrifugal force as it rolls.

The sonic energy so generated is impressed on a bar, typically of steel, by securing the raceway near one end of the bar. As the mass rolls around the raceway, the bar vibrates in its bending mode. A standing wave is produced along the bar having anti-nodes between which nodes are interposed. The bar is supported at the nodes. The bolt is mounted on the bar near an anti-nodal position extending vertically upwardly from the bar. Below the bar, means are provided to exert an upward force on the bar and through the bar on the bolt. The apparatus is set so that the end of the bolt remote from the bar is maintained in engagement with the roof under pressure. As the bar is vibrated, the bolt penetrates into the roof.

Since the practice of this invention does not require that a hole be drilled into the roof, which like the constant-force method requires a cylindrical bolt, the bolt may have any advantageous cross section. Particularly, advantageous is a bolt having a helical contour along its length. The bolt is supported on a hammer which is mounted in a vertical guide extending from the bar. The hammer is constrained against horizontal displacement, but can rotate in the guide. As the hammer is vibrated by the bar, the hammer and bolt are rotated under the action of the helix and the bolt is screwed into the roof.

The mechanical system including the oscillator, the bar and the bolt may be conveniently analyzed by considering its electrical analogy. The respective masses of the oscillator, bar and bolt are analogous to inductances, the respective spring constants of the bar and bolt are analogous to capacitances and the strata damping resistance of the roof is analogous to electrical resistance. The oscillator may be regarded as supplying its energy through its mass (inductance) to a network including in series the mass of the bar, the spring constant of the bar and the strata resistance. The bolt may be regarded as a parallel network of mass and spring constant connected across the resistance and deriving its energy from the drop across the resistance. The amplitude of the vibration of the bar is enhanced by tuning the frequency of the driving oscillator to the mechanical system including the bar, oscillator and bolt.

The centrifugal force of the rotating mass is delivered radially in all directions. A coherent vertical vibration of the bar is necessary to produce the desired result — that of a sonic pile driver. When the oscillator and its housing are placed inside the bar in the practice of this invention, they become a mass extension of the bar itself. Because of its support, the bar vibrates by bending; vibration by expansion and contraction which would be produced by horizontal components of the forces impressed by the mass is suppressed by the stiffness of the bar. Predominately only the vertical components of the generated radial forces are effective to vibrate the bar.

The spring constant of the bolt must be compatible with the spring constant of the bar. If the spring constant of the bolt is too small, it deforms instead of being driven into the strata of the roof.

BRIEF DESCRIPTION OF THE DRAWING

For a better understanding of this invention, both as to its organization and as to its method of operation, together with additional objects and advantages thereof, reference is made to the following description taken in connection with the accompanying drawings, in which:

FIG. 4 is a view in side elevation of the vibratory bar of the apparatus shown in FIG. 1;

FIG. 5 is a fragmental view in section taken along line V—V of FIG. 1;

FIG. 6 is a fragmental view partially in section taken along line VI—VI of FIG. 2 and showing the mechanical oscillator used in the practice of this invention;

FIG. 7 is a view in section taken along line VII—VII of FIG. 6;

FIG. 8 is a view in longitudinal section showing the hammer of the apparatus shown in FIG. 1 and its support and guide;

FIG. 9 is a diagram showing the lubrication circuit for the oscillator and its drive;

FIG. 10 is a view in side elevation of a helical bolt in accordance with this invention; and FIGS. 11*a*, *b*, *c* and *d* are views in transverse section of bolts which may be used in the practice of this invention.

DETAILED DESCRIPTION OF INVENTION

Figure 1:
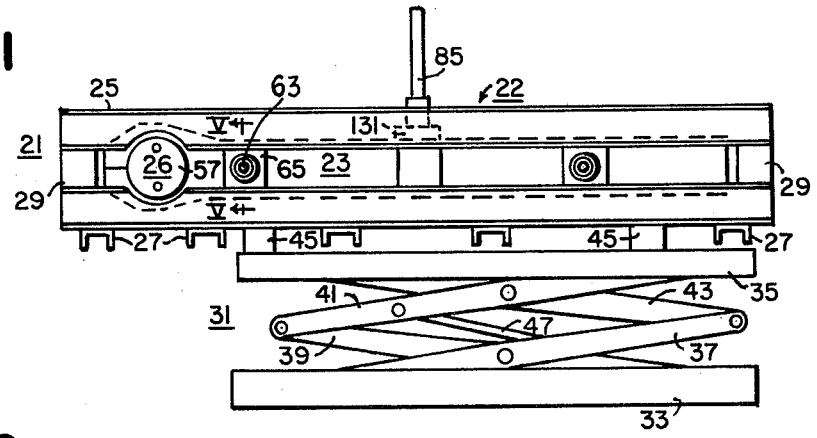
FIG. 1 is a view in side elevation showing an embodiment of this invention with the member applying vertical force to the vibratory bar in a retracted position.

The apparatus shown in FIGS. 1 through 9 includes a frame 21 of generally L form. The leg 22 (FIG. 3) of the frame forms an enclosure for the vibratory bar 23, and the foot 24 of the frame forms enclosures for the oscillator 26. The leg 22 of the frame 21 is composed of C-section beams 25 interconnected horizontally by cross C-section beams 27 and vertically by blocks 29. The foot is composed of plates 28.

The apparatus shown in FIGS. 1 through 9 also includes a double-scissors pallet lift 31 having a base 33 and a table 35. Between the base 33 and the table 35, arms 37, 39, 41 and 43 are pivotally mounted. The arms 37 and 39 are pivotally joined near opposite ends of base 33 and arms 41 and 43 are pivotally joined to opposite ends of table 35. Arms 37 and 41 are pivotally linked at their ends and arms 39 and 43 are pivotally linked at their ends. Arms 37 and 39 and 41 and 43 are pivotally joined at their centers. The arms 37 and 39 are the arms 41 and 43 respectively pivot like two scissors with the ends of their blades pivotally joined. The frame 21 and the structure which it contains and support is mounted on table 35 on blocks 45.

Figure 2:
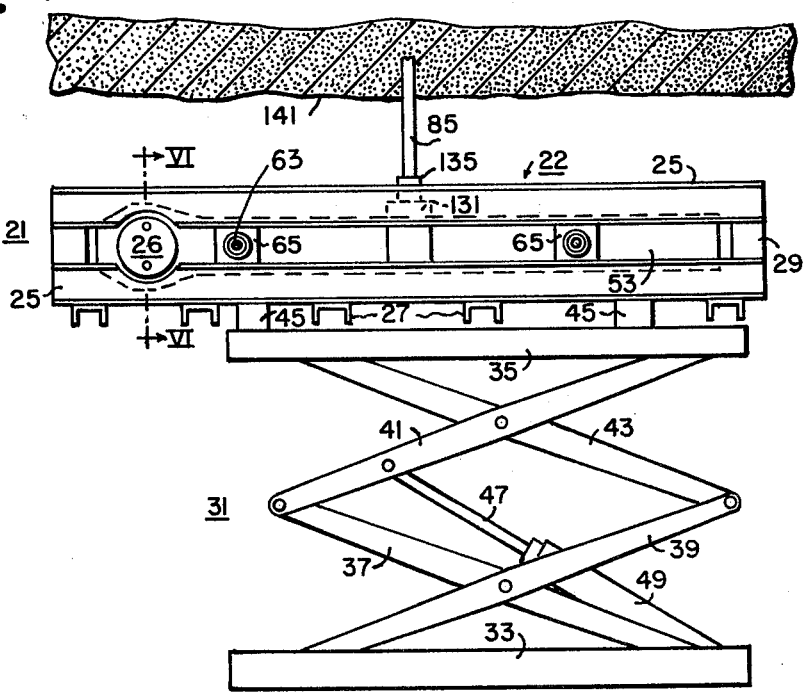
FIG. 2 is a like view with this member in an extended or raised position.
Figure 3:
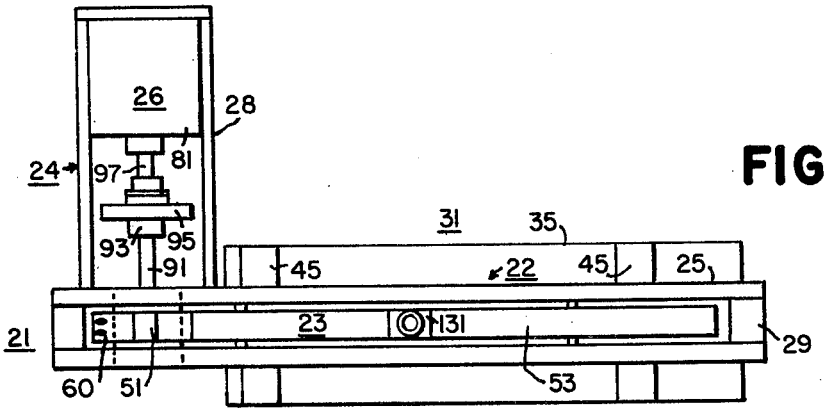
FIG. 3 is a plan view of the apparatus shown in FIGS. 1 and 2.

The double scissors 37 – 43 are actuable hydraulically by a piston rod 47 connected to a piston not shown in a cylinder 49. The end of the rod 47 is connected pivotally to arm 41 and the cylinder is pivotally linked to base 33. If necessary, there may be additional drives for the double scissors; for example, between base 33 and arm 43. With the piston rod 47 retracted, the pallet 31 and the frame 21 are in the retracted position as shown in FIG. 1. With the rod 47 extended, the pallet 31 and the frame 21 are in the raised position as shown in FIG. 2.

The bar 23 (FIG. 4) is of generally T shaped, the T having a short head 51 tapering from the stem 53. It is smooth and highly polished and is typically composed of 4340 steel. The head 51 has a circular opening 55 in which the race 57 of the oscillator 26 (FIG. 1) is clamped. The head 51 has a slit 59 (FIG. 4) permitting the jaws of the head to be separated for insertion of the race 57. Once the race 57 is clamped, the jaws spring back and securely clamp the race 57. Screws (not shown) are inserted in holes 60 in the nose of the head 51 and are secured by nuts not shown. The bar 23 has holes 61 at predetermined nodal positions of the standing wave for receiving pins 63 (FIGS. 1, 2, 5) for suspending the bar. Typically, the bar 23 has a thickness of 3 inches and other dimensions as shown in FIG. 4.

The bar 23 is suspended at its nodal positions from the pins 63. Effective stress-resistant support for the bar 23 is essential. Typically, the bar weighs 400 pounds and the maximum vibrational load delivered by the oscillator is typically between 15,000 and 50,000 pounds. The frame 21 and the pins 63 must be capable of supporting this total loading of 15,400 to 50,400 pounds. Typically, the pins 63 have a diameter of 1 inch and the holes 61 have a diameter such that the pins are a sliding fit in the holes. Each pin 63 is suspended from plates 65 secured front and back between the upper and lower C-section beams 25, (FIG. 5). Each suspension includes on each side, front and back, an outer sleeve 67 welded to the plate 65, an inner sleeve 69 engaging the pin 63, and a bushing 71 of rubber, styrofoam or the like. The bushings 71 effectively isolate the bar 23 from the frame 21 dampening the transient vibrations at start up. The bushings 71 surround and support the pins 63 substantially from the outer end, on each side, of each pin to as near as practicable to the bar 23, thus minimizing the bending moment exerted on the pins 63 by the bar 23. Washers 73 (FIG. 5) are provided near the ends of each pin 63 to suppress outward displacement of the inner sleeves 69 and bushings 71. The washers are held by cotter pins 75. Longitudinal displacement of the bar 23 is prevented by collars 77 which engage each inner bushing 69.

The oscillator 26 (FIG. 6) includes a motor 81 which rotates the roller mass 83 (FIG. 7). Typically, the motor 81 is a Volvo F10B-10 hydraulic motor. This motor rotates at 3000 revolutions per minute and is capable of delivering adequate power to vibrate the shaft and deliver the force required (15,000 to 50,000 pounds typically) to the bolt 85. The mass 83 has an external gear 87 which engages an internal planetary gear 89 in the race 57. The motor 81 drives the mass 83 through a flexible shaft 91 and a spline 93, analogous to a swivel joint, which permits the shaft to move in a generally conical path. A flywheel 95 is coupled to the driving shaft 97 of the motor 81 to smooth out the vibrations reflected from the bar 23. Typically, the flywheel 95 is composed of steel having an outer diameter of about 11 inches and an inner diameter of about 2.125 inches and a thickness of ¾ inch. The resonance of the system is determined by the mass and spring constant of the bar 23 and the associated components. In practice the oscillator 26 is brought up to the speed at which the system resonates. Typically, the resonant frequency is 250 cycles per second. The race 57 and mass 83 are in an enclosure. Likewise, the spline 93 and flywheel 95 are in an enclosure (not shown). These enclosures enable the parts involved to be well lubricated.

A lubrication system (FIG. 9) is provided:

1. To provide lubrication to the spline coupling 93 in the flywheel housing (not shown);
2. To lubricate the gears 87 and 89 inside of the oscillator 26;
3. To pump coolant through the oscillator 26 cooling jacket (not shown).

A centrifugal pump 101 draws oil from a reservoir 103, forcing it through the system's filter 105. The filter 105 provides protection against the plugging of the oscillator 26 and flywheel housing orifices thereby preventing the drive system from overheating. Once the oil passes through the filter, the oil's temperature and pressure is monitored by meters 107 and 109 before it enters a manifold 111. Four valves 113, 115, 117, 119 control the direction and flow rate of the oil through the flywheel housing, oscillator gears 87, 89, oscillator cooling jacket, and the bypass 121 to the reservoir 103. Four drain lines 121, 123, 125, 127 return to the reservoir, and from there the oil is recirculated.

The apparatus, according to this invention, includes a striker plate 131 (FIG. 8) bolted or welded to the top of the bar 23 (FIGS. 1, 2) at an anti-nodal point. For a typical bar of the type shown in FIG. 4, with a standing wave 133 as shown in FIG. 4, striker plate 131 may be secured near the end of the bar remote from the oscillator 26 or at an anti-nodal position intermediate the ends. Typically, for the bar shown in FIG. 4 the striker plate 131 may be a disc of 4-inch diameter. A guide tube 135 is welded centrally to the striker plate 131. The guide tube 135 guides a hammer 137 having a threaded stud 139 on which the bolt 85 is screwed. As the bar 23 vibrates, the hammer pounds the bolt 85 into the roof 141 (FIG. 2); the bolt 85 is maintained in engagement with the roof 141 under pressure by the couble-scissors pallet 31.

The bolts 85 may be hollow cylinders 85*a*, as shown in FIG. 11a. Typically, sections of 1⅝ inch diameter ordinary pipe or 1-inch diameter thick-walled pipe may serve as bolts. The bolts may also be solid cylindrical sections cut from ¾-inch diameter cylindrical bar stock. Since holes are not predrilled in the roof, the bolts may be of other forms than cylindrical. For example, the helical bolt 85*b* shown in FIG. 10 may be used. Bolt 85*b* is formed from a rolled strip of T-Transverse section which is twisted so that the stem 143 of the T has a helical contour. This bolt 85*b* has the advantage that as it is driven into the roof 141, it screws into the roof since the hammer 137 is free to turn in the guide 135 and the bolt 85*b* turns with it. Bolts 85*c*, 85*d*, or 85*e* of T, H and X cross section as shown in FIGS. 11*b*, *c*, *d* may also be used. These bolts are rolled.

A double length bolt for each size may also be used. After the first length is pounded into the roof, the first length is unscrewed from the hammer 137. Then, a second length is screwed into the first and the hammer 137 is screwed into the second length. By setting the number of lengths, a greater length of roof bolt can be pounded into the roof 141.

While preferred embodiments and preferred practice of this invention have been disclosed herein, many modifications thereof are feasible. This invention is not to be restricted except insofar as is necessitated by the spirit of the prior art.

We claim:

1. Apparatus for providing roof support for a coal mine or the like by driving bolts into said roof, the said apparatus including an elongated bar of resilient material, drive means, connected to said bar, for vibrating said bar at a sonic frequency in the bending mode of said bar, thus producing a standing wave, having nodes and anti-nodes, along said bar, means, below said roof, supporting said bar at said nodes, so that said bar vibrates towards and away from said roof with said anti-nodes extending towards and away from said roof, means connecting a said bolt to said bar near an anti-node position therealong, said bolt being connected vertically to said bar to engage, and be driven directly into said roof, by the vibrational movement of said bar toward said roof and means, connected to said bar, exerting a force vertically upwardly to maintain said bolt in continuous engagement under force with said roof as said bolt is being driven directly therein by the vibrational movement of said bar towards said roof.

2. The apparatus of claim 1 wherein the upward force exerting means is a double-scissors pallet lift connected in upward force transmitting relationship with the bar.

3. The apparatus of claim 1 wherein the bolt is in the form of a rod of non-circular transverse cross-section.

4. The method of providing roof support for a coal mine or the like with bolts, the said method being practiced with apparatus including an elongated bar of resilient material and drive means connected to said bar for vibrating said bar at a sonic frequency in the bending mode of said bar, thus producing a standing wave along said bar by supports, below said roof, engaging said bar at the node positions of said standing wave, with the vibrational movement said bar upwardly towards said roof and downwardly away from said roof, mountng a said bolt on the bar at an anti-node position of said bar, said bolt extending vertically upwardly towards said roof from said anti-node position, setting said bar vertically so that said bolt engages said roof, actuating said drive means to vibrate said bar and thus causing said bolt to penetrate directly into said roof, during the upward movement of said bar and exerting a vertical force upwardly on said bar to maintain said bolt continuously in pressure engagement with said roof under the action of said force until said bolt is driven into said roof.

5. The method of claim 4 wherein the bolt has a helical contour and is mounted rotatably about its vertical axis on the bar so that as said bolt is driven into the roof, it is screwed directly into the roof.

6. Apparatus for providing roof support for a coal mine or the like by driving bolts into said roof, the said apparatus including an elongated bar of resilient material, drive means, connected to said bar, for vibrating said bar at a sonic frequency in the bending mode of said bar, thus producing a standing wave, have nodes and anti-nodes along said bar, means supporting said bar at said nodes, means connecting a said bolt to said bar near an anti-node position therealong, said bolt being connected vertically to said bar to engage, and be driven into said roof, said connecting means including a hammer actuable by the vibration of said bar and a vertical guide for said hammer, said bolt being removably secured to said hammer, and means, connected to said bar, exerting a force to maintain said bolt in continuous engagement under force with said roof as said bolt is being driven therein by the vibration of said bar.

7. The apparatus of claim 6 wherein the hammer is free to rotate about a vertical axis in said guide.

8. The apparatus of claim 6 wherein the bolt has a helical contour along its length.

9. The apparatus of claim 6 wherein the bolt is in the form of a rod of non-circular transverse cross-section and has a helical contour along its length.

* * * * *